US007029200B1

(12) United States Patent
Cravens

(10) Patent No.: US 7,029,200 B1
(45) Date of Patent: Apr. 18, 2006

(54) SHORELINE EROSION BARRIER

(75) Inventor: James Cravens, Hamilton, OH (US)

(73) Assignee: Granger Plastics Company, Middletown, OH (US)

( * ) Notice: Subject to any disclaimer, the term of this patent is extended or adjusted under 35 U.S.C. 154(b) by 0 days.

(21) Appl. No.: 10/997,730

(22) Filed: Nov. 24, 2004

Related U.S. Application Data

(63) Continuation of application No. 10/997,226, filed on Nov. 24, 2004, now abandoned.

(51) Int. Cl.
*E02B 3/04* (2006.01)

(52) U.S. Cl. ..... 405/30; 405/15; 405/21; 405/111; 405/114; 405/302.6

(58) Field of Classification Search ..... 405/15, 405/21, 30, 31, 107, 110, 111, 114, 302.6
See application file for complete search history.

(56) References Cited

U.S. PATENT DOCUMENTS

| | | | | |
|---|---|---|---|---|
| 3,387,458 | A | 6/1968 | Jarlan | |
| 3,894,397 | A | 7/1975 | Fair | |
| 4,023,257 | A | 5/1977 | Wright et al. | |
| 4,073,145 | A | 2/1978 | Fair | |
| 4,129,006 | A | 12/1978 | Payne | |
| 4,172,680 | A | 10/1979 | Brown | |
| 4,367,977 | A | 1/1983 | Schaaf et al. | |
| 4,367,978 | A | 1/1983 | Schaaf et al. | |
| 4,479,740 | A | 10/1984 | Schaaf et al. | |
| 4,666,334 | A * | 5/1987 | Karaus | 405/31 |
| 4,708,521 | A | 11/1987 | Kocourek | |
| 4,711,598 | A | 12/1987 | Schaaf et al. | |
| 4,784,520 | A * | 11/1988 | Stevens | 405/21 |
| D302,313 | S | 7/1989 | Lenson | |
| 4,869,617 | A * | 9/1989 | Chiodo | 405/114 |
| 4,877,349 | A | 10/1989 | Greene | |
| 4,978,247 | A | 12/1990 | Lenson | |
| 5,074,707 | A | 12/1991 | Greene | |
| 5,125,765 | A * | 6/1992 | Verble | 405/31 |
| 5,511,902 | A * | 4/1996 | Center | 405/21 |
| 5,586,835 | A | 12/1996 | Fair | |
| 5,921,709 | A * | 7/1999 | Baum et al. | 405/114 |
| 6,059,491 | A * | 5/2000 | Striefel et al. | 405/111 |
| 6,079,902 | A | 6/2000 | Pettee, Jr. | |
| 6,789,776 | B1 | 9/2004 | Gavin | |
| 2004/0156680 | A1 * | 8/2004 | Gibbs | 405/15 |

* cited by examiner

*Primary Examiner*—Frederick L. Lagman
(74) *Attorney, Agent, or Firm*—Wood, Herron & Evans, LLP

(57) ABSTRACT

A barrier for reducing erosion along shorelines includes a barrier body formed as a unitary, molded plastic structure. In one embodiment, the barrier body has at least one elongate passage extending through it, between oppositely disposed first and second sides, and an interior reservoir. A port formed into the barrier body communicates with the interior reservoir to facilitate filling the reservoir with material to thereby add weight to the barrier. The barrier further includes at least one anchor formed into a side of the barrier body and associated with the passage to control shrinkage of the barrier body as it is being molded. In another embodiment, a method of making the barrier body includes placing plastic material in a mold, manipulating the mold to distribute the plastic material within the mold and thereby form the barrier body as a unitary piece, and reducing the shrinkage of the molded barrier body with the anchor.

7 Claims, 8 Drawing Sheets

SHORELINE EROSION BARRIER

CROSS REFERENCE

This application is a continuation of U.S. patent application Ser. No. 10/997,226, filed Nov. 24, 2004, now abandoned.

FIELD OF THE INVENTION

The present invention relates generally to a device for reducing erosion along shorelines.

BACKGROUND OF THE INVENTION

The erosion of shorelines as a consequence of wave action is a well-known phenomenon. Generally, erosion is a function of persistent wave action exerted on beaches comprising sand or fine-shingled material and is most frequently encountered along shorelines of large bodies of water where such wave action can be generated. As a consequence of this persistent wave action, material on the shore tends to be loosened and the continuous reciprocating movement along the shoreline causes such materials to generally erode. The problems of erosion are emphasized along exceptionally long shorelines where the phenomena of littoral drift is enhanced. In those situations, devices such as breakwaters and revetments tend to increase downstream erosion.

In an attempt to combat shoreline erosion, many municipalities have resorted to dredging sand from outlying portions of the body of water and depositing the sand on the beach. The dredging process is generally very expensive and serves only as a temporary solution to the problem as the shore is gradually and continually eroded. Moreover, dredging sand from the floor beneath the body of water creates other environmental concerns such as damage to marine life which inhabit the sea floor.

Other devices for controlling erosion along shorelines have been proposed in the form of barriers positioned along the shoreline, or at a distance in the water spaced from the shoreline, to dissipate wave action. However, many of these devices do not aid in building beach behind the barrier structures, and some actually cause increased erosion in front of the barrier structures. To address this problem, some devices have been configured to facilitate the deposition of sand on the beach behind the barrier structures. A large majority of these devices are formed from concrete material and are therefore susceptible to wear and erosion by the natural wave action they are intended to combat. Accordingly, these structures usually become cracked, eroded, or otherwise damaged over the course of time.

U.S. Pat. No. 4,129,006 to Payne is directed to an erosion control system which, in one embodiment, comprises modular, hollow units. The hollow units may be filled with water to add sufficient weight to moor the system on the beach. Several of the modular units are coupled together with tie rods to form a barrier structure for combating erosion.

Accordingly, despite the various proposed devices and methods for controlling erosion along shorelines, no one method or device has been widely accepted, and the control of erosion along shorelines continues to be a topic of intensive research. A need therefore exists for an erosion control barrier which addresses these and other drawbacks of the prior art.

SUMMARY OF THE INVENTION

The present invention provides a barrier for controlling erosion along shorelines. Each barrier is a modular unit that can be arranged together with several other such barriers to form a barrier wall along a shoreline. In one embodiment, the barrier comprises a unitary, molded plastic body with opposing first and second sides and an interior reservoir. At least one elongate passage extends through the barrier body between the first and second sides to permit water to flow through the barrier, from a seaward facing side to a landward facing side. At least one anchor formed into the second side of the barrier is associated with the elongate passage. The anchor controls shrinkage of the molded barrier body during manufacture of the barrier. The barrier further includes a port formed into the barrier body and communicating with the interior reservoir to facilitate filling the reservoir with concrete, sand, water, stones, or other material.

In another embodiment, the elongate passage includes first and second apertures formed on the first and second sides of the barrier, respectively. The apertures are sized such that the second aperture is smaller than the first aperture, and the elongate passage is tapered along its length between the first and second apertures. When the barrier is oriented with the first side facing seaward, water is forced through the passage by wave action and the tapered shape acts like a nozzle to increase the velocity of the water through the passage. As the water exits the second aperture on the second, landward facing side, it is propelled a distance behind the barrier. As the water flows back toward the shore, it is impeded by the barrier so that any sand that is mixed with the water settles out to build the beach behind the barrier. While water can flow through the passage back toward the shore, the smaller aperture on the second side helps to slow the flow and thereby facilitate settling sand out of the water.

In another embodiment of the invention, a barrier according to the invention is formed in a rotational molding process. The mold used to form the barrier includes a cavity that defines the exterior shape of the barrier, at least one elongate core extending through the cavity, and an anchor affixed within the cavity proximate the core. The method includes placing thermoplastic material in the mold, heating the mold, manipulating the mold to distribute the thermoplastic material through the mold cavity and thereby form the unitary barrier, and reducing shrinkage of the molded barrier with the anchor.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
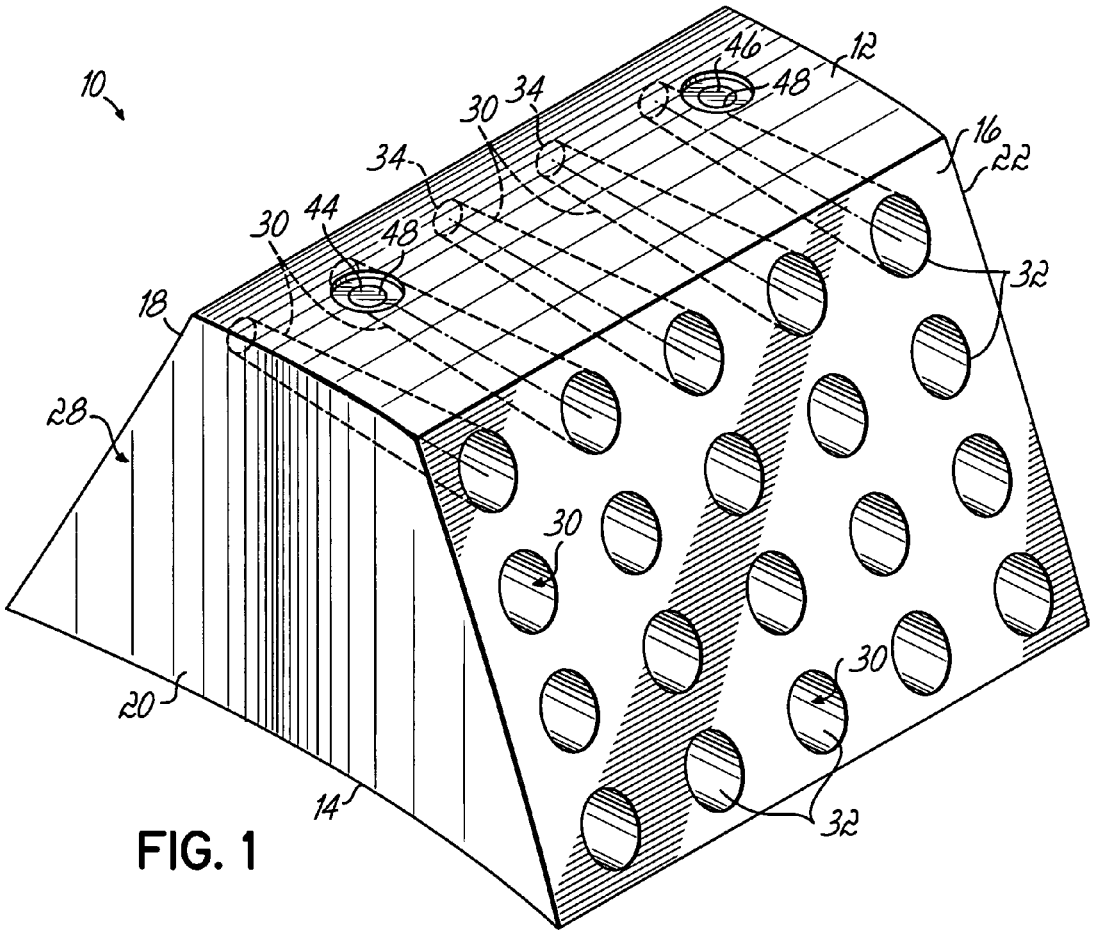
FIG. 1 is a perspective view of an exemplary erosion barrier according to the present invention.
Figure 2:
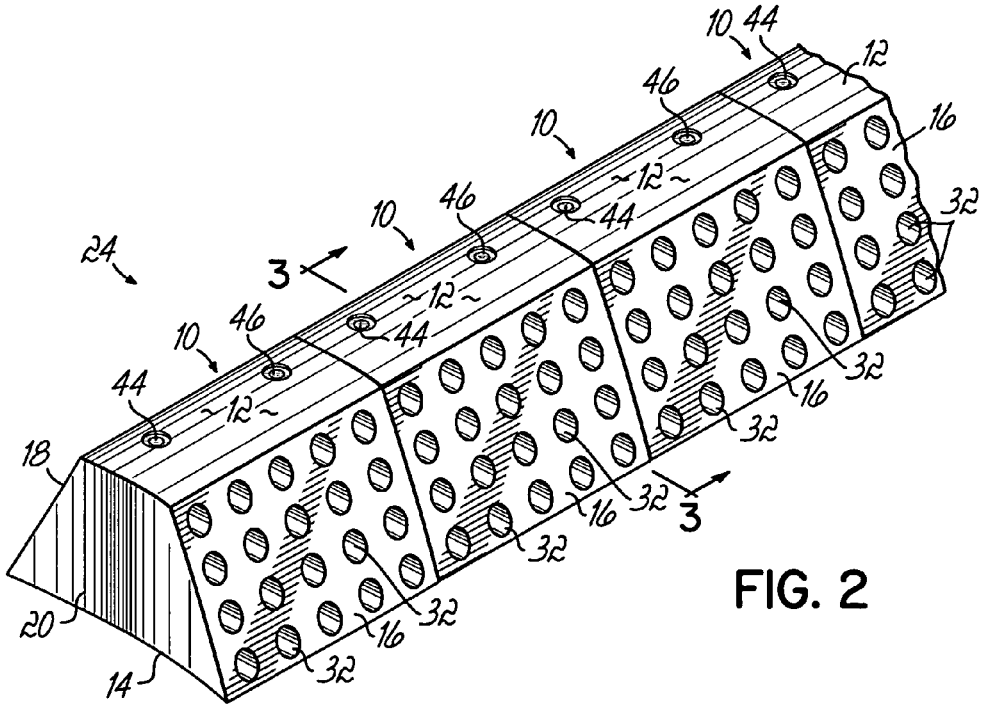
FIG. 2 is a perspective view depicting several barriers of FIG. 1 arranged in an interlocking manner.
Figure 4:
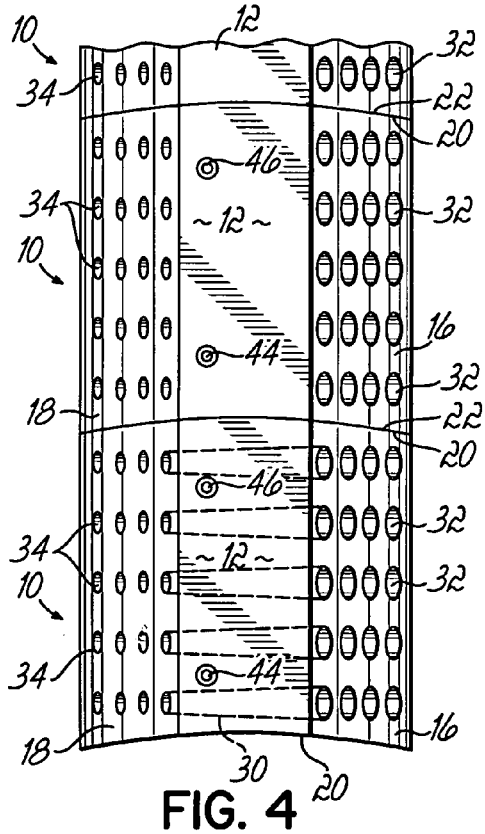
FIG. 4 is a top plan view of the barriers of FIG. 2.
Figure 8:
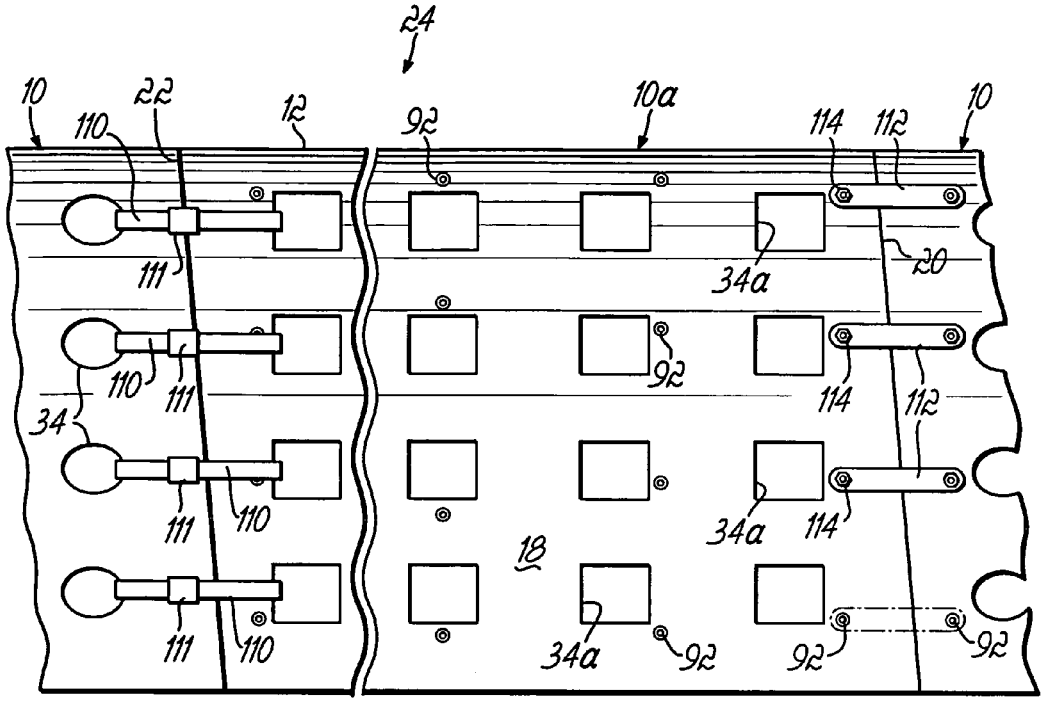
FIG. 8 is a rear elevation view, similar to FIG. 6, depicting several barriers arranged end-to-end.

FIG. 1 depicts an exemplary erosion control barrier 10, according to the present invention. In this embodiment, the barrier has the general shape of a trapezoidal prism with substantially horizontal top and bottom walls 12, 14, first and second opposing, inclined sidewalls 16, 18, and first and second opposing end walls 20, 22. The first and second sidewalls 16, 18 are inclined toward one another, from the bottom wall 14 toward the top wall 12, to form the generally trapezoidal shape. While the first and second end walls 20, 22 are substantially vertically oriented, they are formed as convex and concave arcuate surfaces that extend between the first and second sidewalls 16, 18, respectively. The convex and concave surfaces are complementary so that multiple barriers 10 may be aligned in an end-to-end fashion with their first and second end walls 20, 22 engaging one another to form a barrier wall 24, as depicted in FIGS. 2, 4 and 8, and described more fully below.

Figure 7:
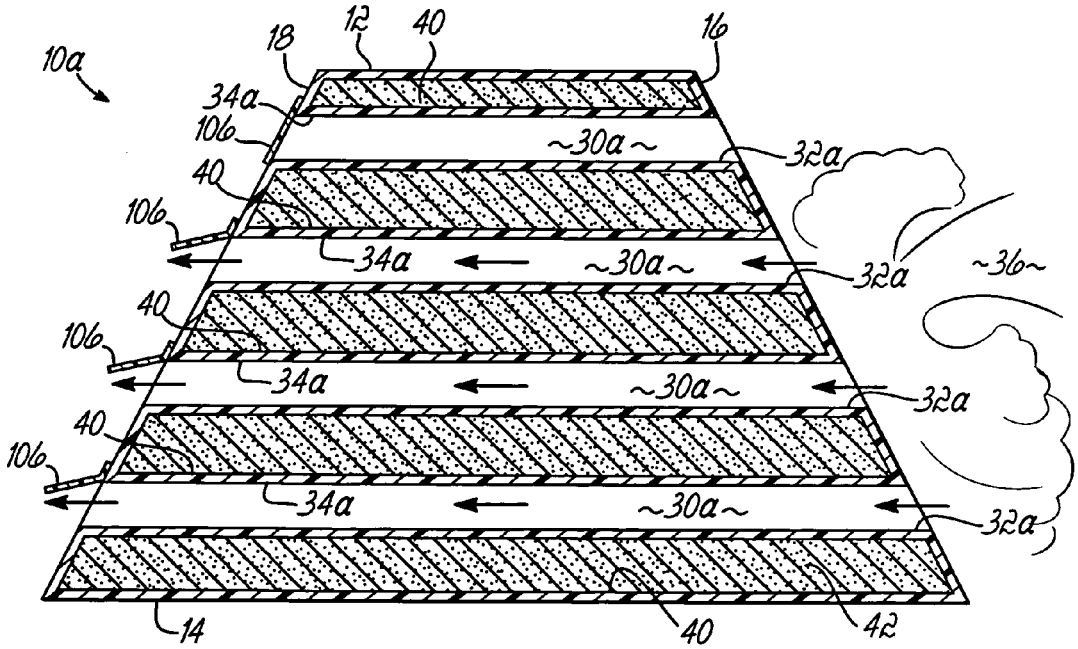
FIG. 7 is a cross-sectional view similar to FIG. 3, depicting another embodiment of an erosion barrier according to the present invention.

A plurality of elongate passages 30 are formed through the barrier 10, between the first and second sidewalls 16, 18. Each passage 30 includes first and second apertures 32, 34 formed on the first, and second sidewalls 16, 18, respectively, whereby fluid, such as seawater, may pass entirely through the passages 30 from the first side to the second side. In the embodiment shown, the passages are generally cylindrical in shape and the second apertures 34 are smaller than the first apertures 32. The passages 30 are correspondingly tapered along their lengths from the first apertures 32 to the second apertures 34. While the passages 30 and apertures 32, 34 are depicted herein as having generally circular cross sections or shapes, it will be recognized that the passages 30 and apertures 32, 34 may be formed in various other shapes, as may be desired, and the passages need not be tapered. As a non-limiting example, FIGS. 7 and 8 depict another embodiment of a barrier 10*a* wherein the apertures 32*a*, 34*a* are substantially the same size and the passages 30*a* are not tapered, though they may formed with a slight draft to facilitate manufacture. The passages 30*a* and apertures 32*a*, 34*a* have generally rectangular cross sectional shapes, as best seen in FIG. 8.

Figure 3:
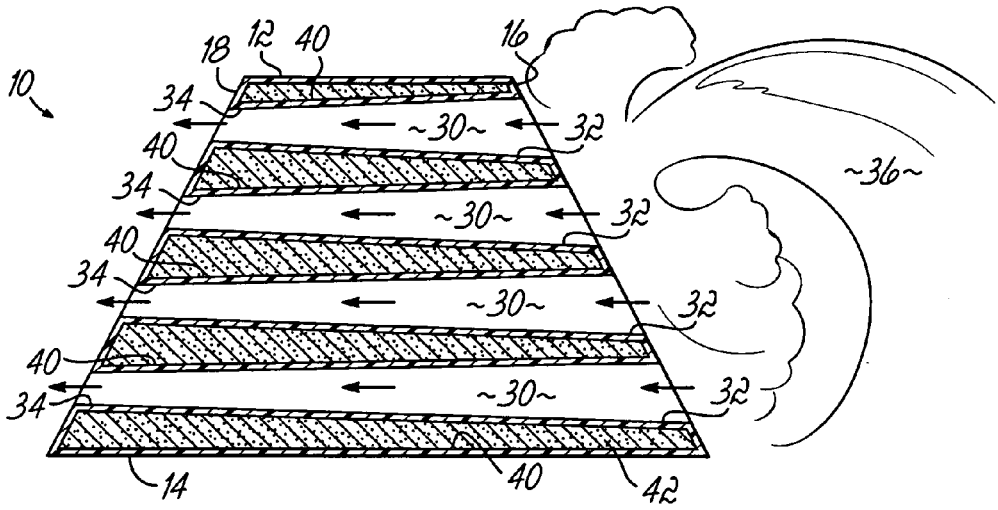
FIG. 3 is a cross-sectional view of a barrier of FIG. 2, taken along line 3—3.

When one or more barriers 10 are positioned along a shoreline, water and sand from waves 36 impacting the first, or seaward-facing sidewall 16 of the barrier 10 enter the first apertures 32 and are forced by the wave action through the passages 30 to exit from the second apertures 34 on the second, or landward-facing sidewall 18 of the barrier 10, as depicted in FIG. 3. In the embodiments where the passages 30 are tapered, the passages 30 act as nozzles to increase the velocity of the water traveling through the passages 30 so that the water is ejected from the second apertures 34 and propelled a distance behind the second sidewall 18 of the barrier 10. As the water flows back toward the shoreline, it is impeded by the barrier 10 so that sand which is intermixed with the water settles out and is deposited behind the second sidewall 18 of the barrier 10 whereby the beach is increased on the landward side of the barrier 10. The relatively smaller size of the second apertures 34 formed on the second sidewall 18 of the barrier 10 further increases the beach building functionality of the barrier by impeding the flow of water back through the passages 30 and giving the sand additional time to settle out of the water.

By aligning multiple barriers 10 end-to-end along a stretch of shoreline, the barriers form a barrier wall 24 that dissipates wave action, and accretes the beach behind the barriers, as described above. The interlockinq connection provided by the respective arcuate first and second end walls 20, 22 helps adjacent barriers 10 resist movement under the force of impacting waves 36. Moreover, the respective arcuate shapes facilitate offsetting consecutive barriers relative to one another, in an angular fashion, so that the barrier wall 24 can be arranged to follow the contour of the shoreline.

Figure 5A:
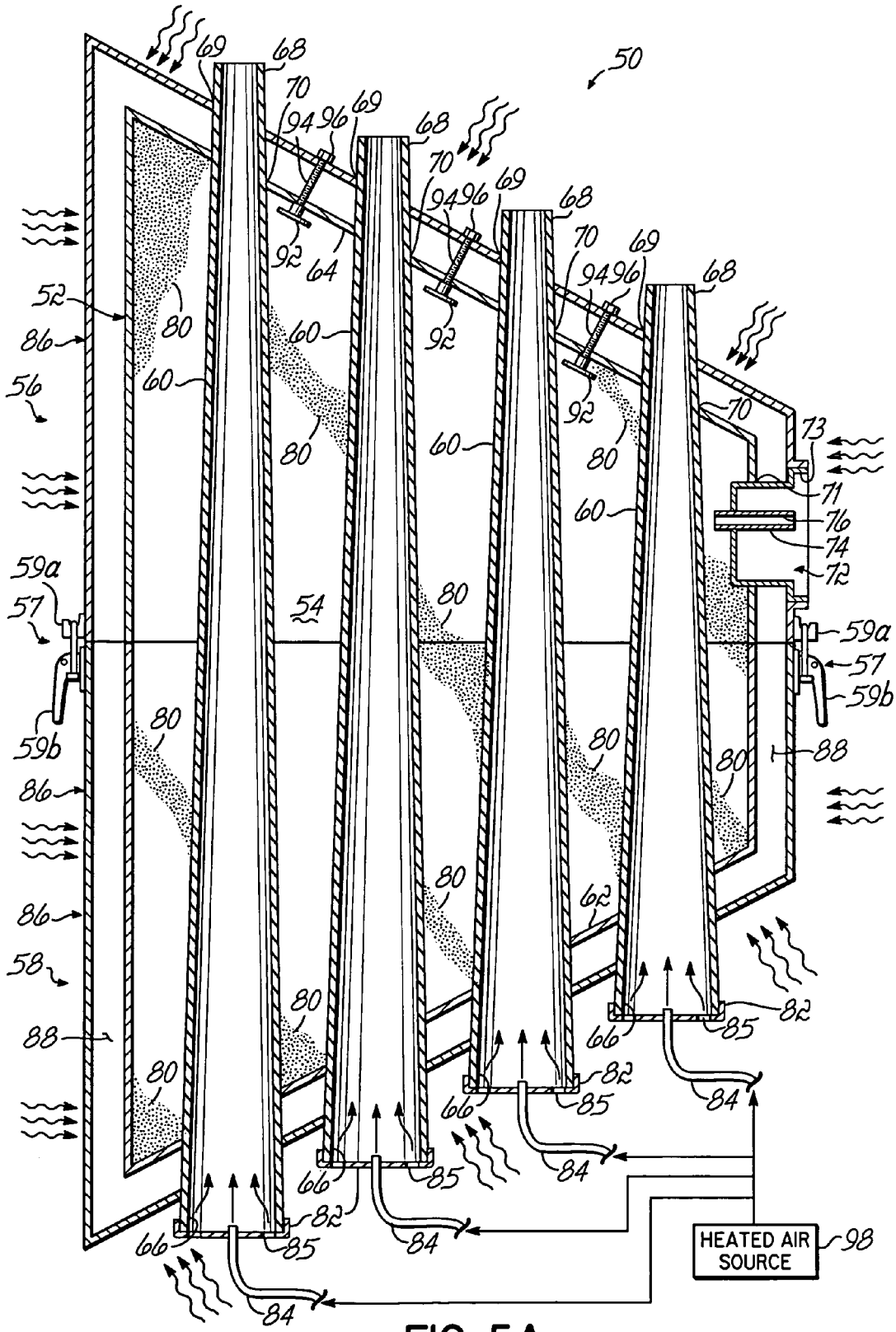
FIGS. 5A–5D are schematic, cross-sectional views depicting a molding process for manufacturing the barrier of FIG. 1.
Figure 5B:
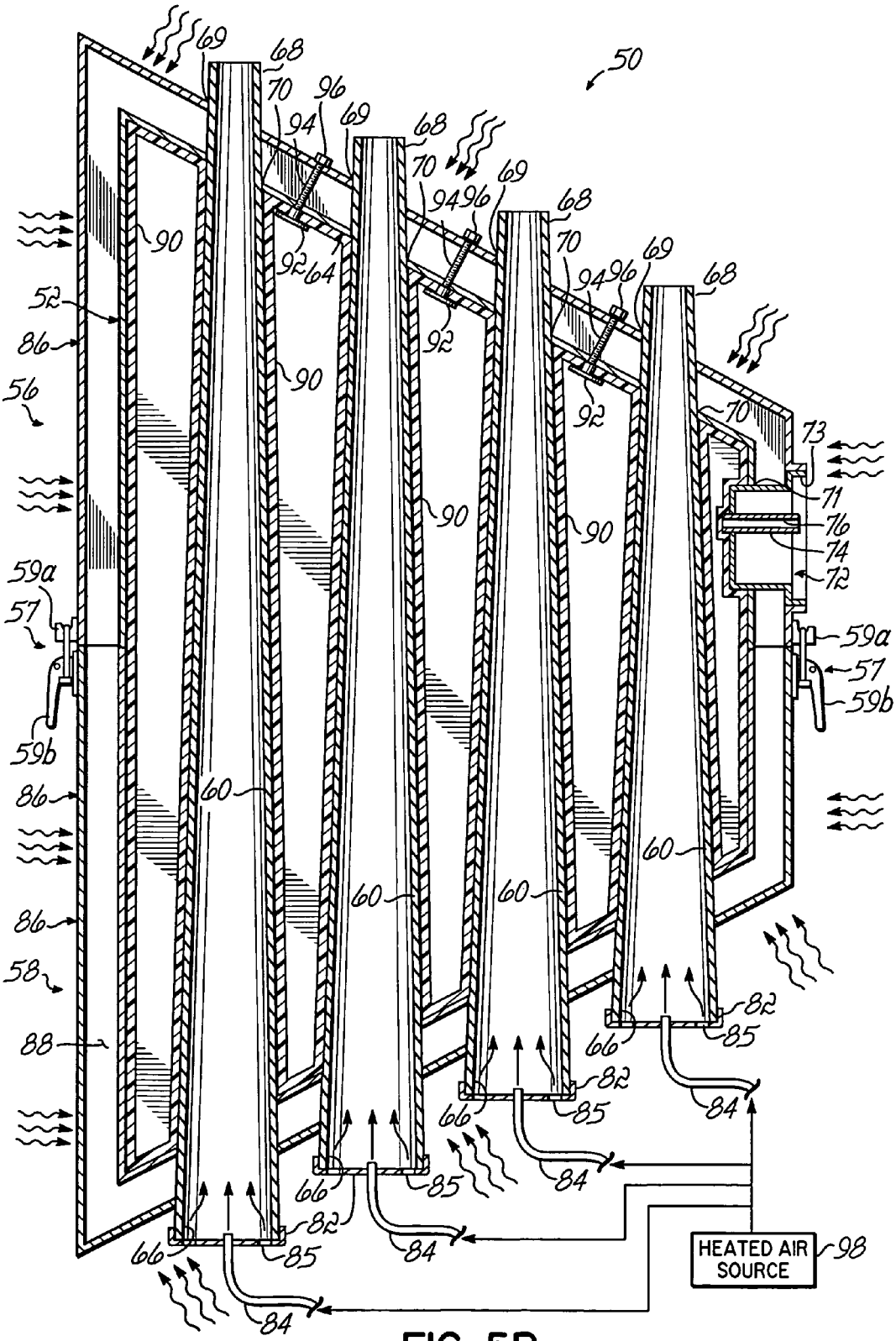
Figure 5C:
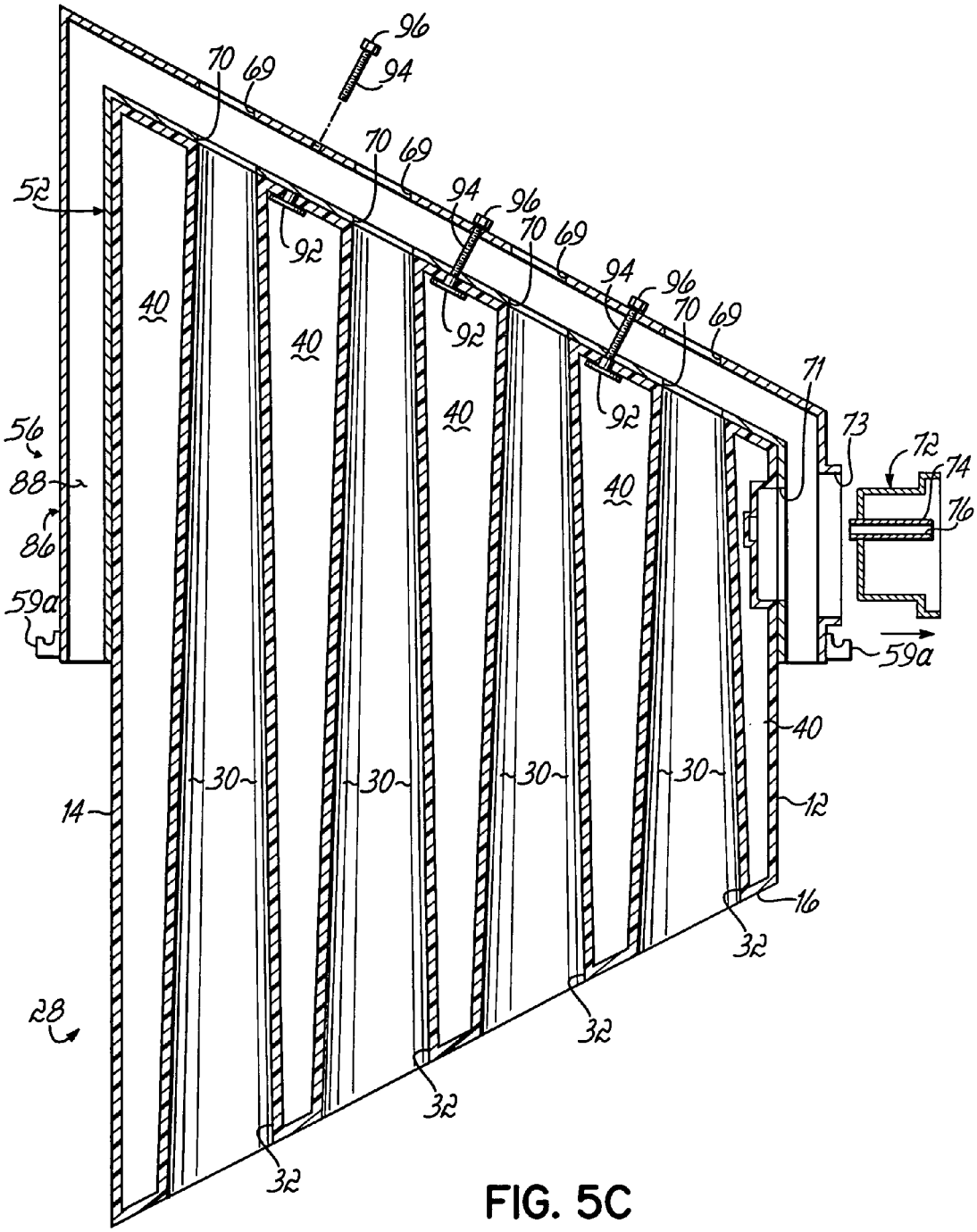
Figure 5D:
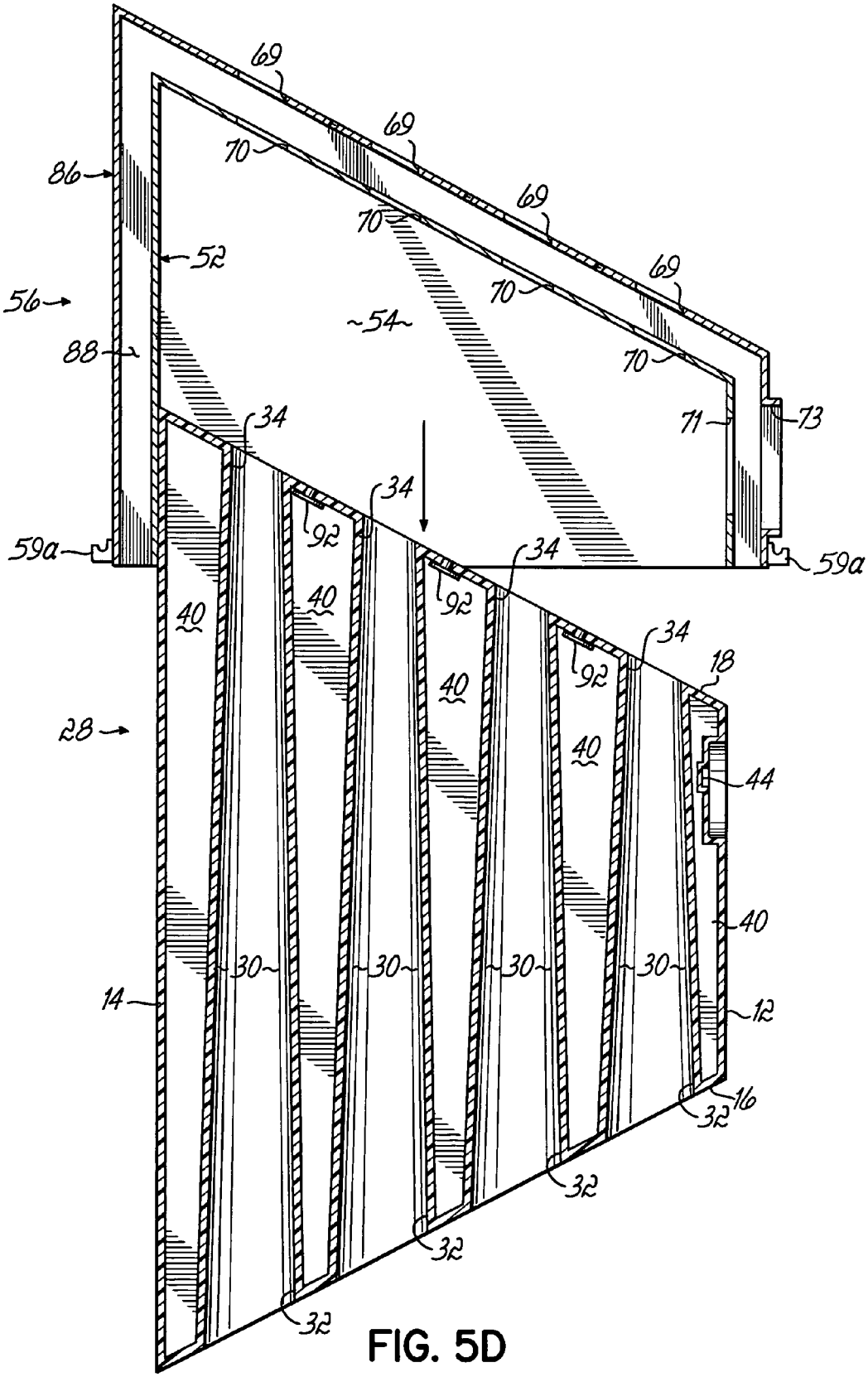

In one embodiment, the barrier 10 is formed as a unitary, molded, plastic, hollow barrier body 28 having an interior reservoir 40, as depicted in FIGS. 3 and 5D. The reservoir 40 may be filled with a material to increase the weight of the barrier and facilitate mooring the barrier 10 along a shoreline. Such fill materials include, but are not limited to, sand or other sedimentary material, water, small stones, or other material. In one embodiment, the barrier body 28 is filled with concrete material 42. To facilitate filling the interior reservoir 40, a port 44 may be formed into the top wall 12 of the barrier body for communication with the interior reservoir 40. A second port or vent 46 may be formed in the top wall 12 to facilitate the evacuation of air from within the interior reservoir 40 as the fill material is being added. The port 44 and vent 46 may thereafter be capped with a cover 48, or otherwise sealed, to retain the fill material within the interior reservoir 40. In one embodiment, covers 48 over the port 44 and vent 46 are friction welded or spin welded to the top wall 12.

The barrier 10 according to the present invention facilitates transportation and erection of a barrier wall 24. Specifically, unfilled barrier bodies 28 may be easily transported to an erection site and positioned along a shoreline as desired. Thereafter, the individual barrier bodies 28 may be filled with a fill material, such as concrete, sand, water, small stones, or other material, to help moor the assembled barrier wall 24 in position. Because of the modular design of the individual barriers 10, they may be repositioned to form a new barrier wall 24 along a different section of the beach after a period of time has passed and/or after sufficient accretion of beach behind the previous barrier wall 24 has been obtained. In this manner, the barriers 10 may be reused to facilitate increasing the beach area.

The barrier body 28 may be formed from polyethylene, polypropylene, vinyl, nylon, plastisol, or any other plastic material that is impervious to water and provides good wear resistance. In one embodiment, the barrier body 28 is formed from linear low-density polyethylene available, for example, from Exxon-Mobile Corporation. Although the dimensions of the barrier may vary, in one embodiment, a barrier 10 in accordance with the present invention has an overall height of about 36 inches, an overall length of about 60 inches, and an overall width of about 60 inches.

Referring now to FIGS. 5A–5D, a method for manufacturing an erosion barrier 10 using a rotational molding process will now be described. In this embodiment, the rotational molding process forms the unitary molded plastic barrier body 28. As depicted in FIG. 5A, the rotational mold 50 comprises a mold shell 52 with an internal cavity 54 having surfaces that define the corresponding external surfaces of the molded barrier body 28. The mold shell 52 will generally include one or more mold sections which may be separated to permit the molded barrier body 28 to be removed from the cavity 54. In the embodiment shown, the mold 50 comprises at least upper and lower mold sections 56, 58, but it will be recognized that the mold 50 may include other separable sections to facilitate molding the barrier body 28 and removing the barrier body 28 from the mold cavity 54. In the embodiment shown, the upper and lower mold sections 56, 58 are secured together by clamps or hasps 57 with corresponding components 59*a*, 59*b* disposed on the upper and lower mold sections 56, 58, respectively.

A plurality of tapered tubes 60 extend through the mold cavity 54, between spaced opposing sides 62, 64, to form the tapered passages 30 through the barrier body 28. In this embodiment, the wide ends 66 of tubes 60 are fixed to the lower section 58 of the mold 50 and the narrower ends 68 of the tubes 60 extend through and sealingly engage corresponding apertures 69, 70 formed in the upper section 56 of the mold 50. In the embodiment shown, the tubes 60 are formed from aluminum material and their exposed surfaces are covered with a Teflon® coating that resists adhesion of the formed plastic barrier body 28 and facilitates removal of the barrier body 28 from the mold 50.

The upper section 56 of the mold 50 includes one or more core plugs 72 (only one shown) that define the port 44 and vent 46 formed into the top surface 12 of the barrier body 28. The core plugs 72 are installed through apertures 71, 73 formed in the mold 50. Teflon® tubes 74 extend through the wall of the mold 50 at the core plugs 72 and communicate with the mold cavity 54 via passages 76 to vent the cavity 54 during the rotational molding process. Because the tubes are formed from Teflon® material, the plastic material used to form the barrier body 28 will not adhere to the tube 74.

To form the barrier body 28, mold release agent is applied to the interior surfaces of the mold cavity 54 and to the tapered tubes 60 while the upper and lower mold sections 56, 58 are separated. The mold release agent may be any solid or water-based mold release agent. In one embodiment, the mold release agent is TraSys™ 420 available from DuPont of Wilmington, Del. Resin material 80 for forming the barrier body 28 is then added to the mold cavity 54 and the upper and lower sections 56, 58 are secured together to seal the mold cavity 54. The closed mold 50 is then placed in a conventional rotational molding oven and is manipulated about at least two orthogonal axes to cause the resin material 80 to uniformly coat the interior surfaces of the mold 50 as the mold 50 is heated, as known in the art. As the interior surfaces of the mold 50 become hot, the resin material 80 melts and fuses together to form wall surfaces 90 that define the barrier body 28.

To ensure that the passages 30 through the barrier body 28 are properly formed, pressurized, heated air from a heated air source 98 is forced through the tapered tubes 60 to facilitate heating the tubes. To accomplish this, the wide ends 66 of the tapered tubes 60 are closed off with caps 82 and heated air is forced through the tubes 60 by inlet air lines 84 connected to the heated air source 98 and extending through the caps 82. In one embodiment, the caps 82 include apertures 85 formed therethrough. Additional heated air from the oven is entrained by the pressurized, heated air to flow through the apertures 85 and into the wide ends 66 of the tapered tubes 60. This additional heated air further facilitates heating the tubes 60 as it flows through the tubes and out the narrow ends 68.

In another embodiment, the passage 30 are formed before other portions of the barrier body 28 to further ensure proper formation of the passages 30. Accordingly, the mold 50 includes an outer shell 86 spaced a distance from the mold shell 52 to create an air space 88 between the mold shell 52 and the outer shell 86. The air space 88 delays heating of the mold shell 52 in the molding oven and allows the resin material 80 to adhere first to the tapered tubes 60 and thereby form the passages 30 prior to adhering and forming on the other portions of the mold shell 52. FIG. 5B depicts the mold 50 after all of the wall surfaces 90 of the barrier body 28 have formed in the interior cavity 54 of the mold during the rotational molding process.

Due to the large size of the barrier body 28, and to the increased surface area caused by the tapered tubes 60 used to form the passages 30 through the barrier body 28, there is a tendency for the barrier body 28 to stick in the mold 50. Difficulty removing the barrier body 28 from the mold 50 is exacerbated due to the shrinkage of the fused resin material 80 on the interior surfaces, particularly the tapered tubes 60, once the barrier body 28 has been formed. To facilitate removing the barrier body 28 from the mold 50, the mold 50 is outfitted with anchors 92 disposed in the side of the mold that forms the second sidewall 18 of the barrier body 28.

In the embodiment shown, the anchors 92 are threaded inserts, such as part no. F2-CT38-⅜-16×0.5 available from Rotaloc International, LLC of Littleton, Colo. The threaded inserts are secured within the interior cavity 54 of the mold 50 by threaded rods 94 that extend through the mold shell 52 and outer shell 86. The threaded rods 94 may be secured to the mold 50 by nuts 96 provided on the threaded rod 94. Alternatively, the threaded inserts may be secured to the interior cavity 54 of the mold 50 by appropriately sized bolts. As the resin material 80 melts and fuses together, the anchors 92 become embedded in the second sidewall 18 and help to reduce the shrinkage of the barrier body 28 near the tubes 60.

After the resin material has adhered to and formed the walls 90 of the barrier body 28 on the interior surfaces of the mold 50, the mold is removed from the oven and allowed to cool. Cooling may be accomplished by ambient air, forced air, water quench, or various combinations thereof. When the mold 50 and formed barrier body 28 have cooled, the core plugs 72 are removed and the clamps 57 are released so that the lower section 58 of the mold 50, to which the wide ends 66 of the tapered tubes 60 are attached, may be separated from the upper section 56 of the mold. The barrier body 28 remains secured to the upper section 56 of the mold by the anchors 92 attached thereto, as depicted in FIG. 5C. The threaded rods 94 or bolts may be removed from the upper portion 56 of the mold 50 to release the threaded inserts 92 and the barrier body 28 may then be removed from the upper portion 56 of the mold 50, as depicted in FIG. 5D.

Figure 6:
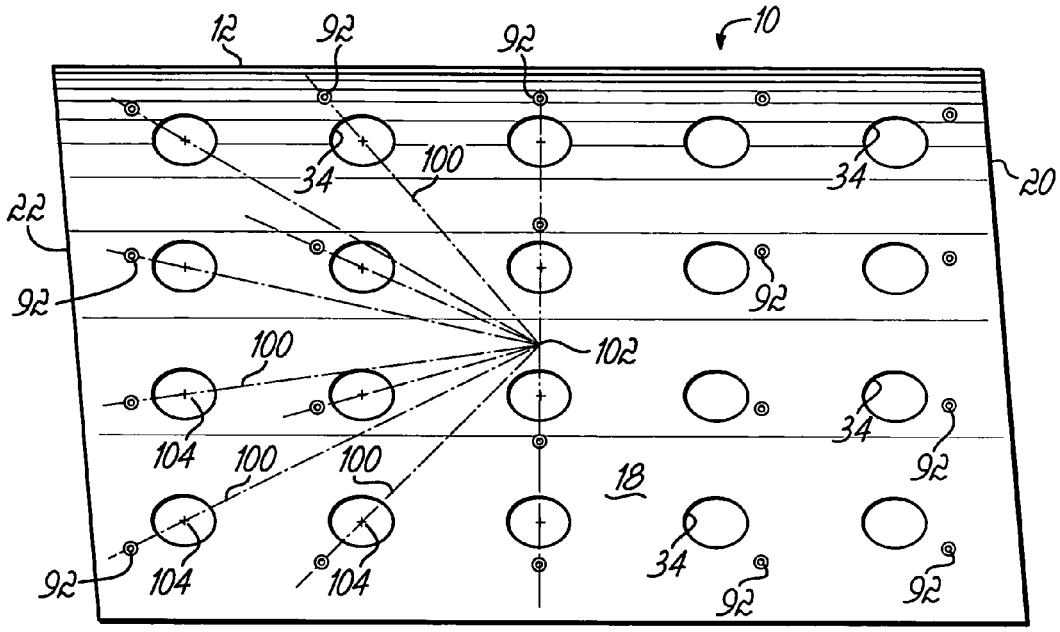
FIG. 6 is a rear elevation view of the barrier of FIG. 1.

In another embodiment of the invention, the barrier body 28 includes an anchor 92 formed into the second sidewall 18 and associated with each of the passages 30 formed through the barrier body 28, as depicted in FIG. 6. In this embodiment, each anchor 92 is located on the second sidewall 18 along a line 100 extending from a geometric center 102 of the second sidewall 18 and through the axial center 104 of the aperture 34 that is respectively associated with the anchor 92. By positioning the anchors 92 in this fashion, the anchors resist shrinkage of the wall surfaces 90 in the vicinity of the tubes 60 of the mold 50, after the barrier body 28 is formed in the mold 50, so that the barrier body 28 may be more easily removed from the mold, as described above.

FIG. 7 depicts another exemplary barrier 10*a* similar to barrier 10 described above, but having non-tapered passages 30*a* extending between the first and second sidewalls 16, 18.

In FIG. 7, features corresponding to similar features of barrier 10 have been similarly numbered. Barrier 10*a* further includes baffles 106 coupled to the second sidewall 18, proximate the second apertures 34*a*, to help dissipate wave energy as water is forced through the passages 30*a*. In the embodiment shown, the baffles 106 comprise flaps of material that are fixed to the second sidewall 18 such that the flaps are biased to cover one or more of the second apertures 34*a*. As water is forced through the passages 30*a* by wave action, the baffles 106 are moved outwardly, away from the sidewall 18, by the water. The water is thereafter ejected from the second apertures 34*a* as described above. After the water has passed out of the second apertures 34*a*, baffles 160 return to their original positions covering the second apertures 34*a*. As water that was ejected behind barrier 10*a* returns toward the shoreline, baffles 160 prevent the water from re-entering the passages 30*a*. Accordingly, the baffles 160 further slow the flow of water toward the shoreline to facilitate settling sand out of the water. If desired, one or more of the second apertures 34*a* may be left uncovered by baffles 160, to provide a path for the water returning toward the shoreline.

FIG. 8 depicts the landward-facing side of a barrier wall 24 formed by a plurality of barriers 10, 10*a* wherein adjacent barriers are secured together by coupling members. The coupling members further stabilize the individual barriers 10, 10*a* against movement by waves that impact the barriers. In one embodiment, the coupling members comprise flexible cables or straps 110 routed through the passages 30, 30*a* of adjacent barriers 10, 10*a*. The ends of the straps 110 may be secured together by crimp fasteners 111, splices, rivets, turnbuckles, or any other suitable method. In another embodiment, the coupling members comprise tethers 112 that are secured to respective anchors 92 on the second sides 18 of adjacent barriers 10, 10*a*. When the anchors 92 comprise threaded inserts as described above, the tethers 112 may be secured to the anchors 92 by fasteners 114. While the tethers 112 are shown and described herein as being secured to the second sides 18 of the barriers 10, 10*a*, it will be appreciated that additional tethers 112 may be secured to the first sides of the barriers in a similar fashion. The straps 110 and tethers 112 may be formed from any material suitable for securing the barriers together and resisting exposure to seawater and the environment. In one embodiment, the straps 110 and tethers 112 are formed from nylon material.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A barrier for reducing erosion along a shoreline, comprising:

a unitary, rotationally molded barrier body defining at least one sidewall and a hollow interior portion;

at least one passage extending through said barrier body; and at least one anchor integrally molded into said sidewall, said anchor operative to control shrinkage of said molded barrier body in the vicinity of said anchor during manufacture of the barrier.

2. The barrier of claim 1, wherein said anchor is located along a line extending between an axial centerline of said passage and a geometric center of said sidewall of said barrier body.

3. The barrier of claim 1, wherein said passage includes first and second apertures located at respective ends thereof, said first aperture being larger than said second aperture such that said passage is tapered between said first and second apertures.

4. The barrier of claim 1, wherein said anchor is an insert having Internal threads formed therein.

5. The barrier of claim 1, further comprising a coupling member connected to said barrier body for securing said barrier body to an adjacent barrier.

6. The barrier of claim 5, wherein said coupling member comprises a strap routed through said passage.

7. The barrier of claim 5, wherein said coupling member comprises a tether affixed to said anchor.

* * * * *